US006534913B1

(12) United States Patent
Perrin et al.

(10) Patent No.: US 6,534,913 B1
(45) Date of Patent: Mar. 18, 2003

(54) ELECTRON SOURCE WITH MICROTIPS, WITH FOCUSING GRID AND HIGH MICROTIP DENSITY, AND FLAT SCREEN USING SAME

(75) Inventors: Aimé Perrin, St Ismier (FR); Brigitte Montmayeul, Bernin (FR); Robert Meyer, St Nazaire les Eymes (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/509,542

(22) PCT Filed: Oct. 13, 1998

(86) PCT No.: PCT/FR98/02197

§ 371 (c)(1),
(2), (4) Date: Jan. 26, 2001

(87) PCT Pub. No.: WO99/19896

PCT Pub. Date: Apr. 22, 1999

(30) Foreign Application Priority Data

Oct. 14, 1997 (FR) ..... 97 12826

(51) Int. Cl.[7] ..... H01J 3/02; H01J 9/02

(52) U.S. Cl. ..... 313/497; 313/306; 313/309; 445/51

(58) Field of Search ..... 313/495, 496, 313/497, 422, 336, 309, 351, 306; 445/50, 51

(56) References Cited

U.S. PATENT DOCUMENTS

| | | | | |
|---|---|---|---|---|
| 4,857,161 A | | 8/1989 | Borel et al. | 313/309 |
| 4,940,916 A | | 7/1990 | Borel et al. | 313/306 |
| 5,063,327 A | * | 11/1991 | Brodie et al. | 313/495 |
| 5,496,199 A | | 3/1996 | Makishima et al. | 445/4 |
| 5,543,691 A | | 8/1996 | Palevsky et al. | 315/366 |
| 5,786,795 A | | 7/1998 | Kishino et al. | 345/75 |
| 5,981,304 A | * | 11/1999 | Perrin et al. | 445/50 |
| 6,210,246 B1 | * | 4/2001 | Perrin et al. | 445/50 |

FOREIGN PATENT DOCUMENTS

| | | | |
|---|---|---|---|
| EP | 0 614 209 | 9/1994 | |
| FR | 2 593 953 | 8/1987 | |
| FR | 2 623 013 | 5/1989 | |
| FR | 2 712 426 | 5/1995 | |
| WO | WO 95/20821 | 8/1995 | |
| WO | WO 99/62093 | * 12/1999 | H01J/9/02 |

* cited by examiner

*Primary Examiner*—Michael H. Day
(74) *Attorney, Agent, or Firm*—Oblon, Spivak, McClelland, Maier & Neustadt, P.C.

(57) ABSTRACT

A microtip electron source including at least one electron emission zone composed of a plurality of microtips connected electrically to a cathode conductor. At least one gate electrode is positioned opposite the electron emission zone and pierced with apertures located opposite the microtips, to extract the electrons from the microtips. An emitted electron focusing gate is positioned opposite the gate electrode, and includes an aperture unit including at least one slit located opposite at least two successive microtips. A flat display screen can include such a microtip electron source. Further, a manufacturing process of such an electron source is disclosed.

11 Claims, 8 Drawing Sheets

ELECTRON SOURCE WITH MICROTIPS, WITH FOCUSING GRID AND HIGH MICROTIP DENSITY, AND FLAT SCREEN USING SAME

BACKGROUND OF THE INVENTION

1. Field of the Invention

The present invention relates to a microtip, focusing gate and high microtip density electron source. It also relates to a flat screen using such a source.

2. Discussion of the Background

The documents FR-A-2 593 953 and FR-A-2 623 013 describe field emission-excited cathodoluminescence display devices. These devices comprise a microtip emitting cathode electron source.

As an illustration, FIG. 1 is a transversal section view of such a microtip display screen. For simplification purposes, only a few aligned microtips have been represented. The screen is composed of a cathode 1, which is a plane structure, positioned opposite another plane structure forming the anode 2. The cathode 1 and the anode 2 are separated by a space in which a vacuum is produced. The cathode 1 comprises a glass substrate 11 on which the conductive level 12 in contact with the electron emitting tips 13 is deposited. The conductive level 12 is coated with an insulating layer 14, e.g. silica, which is itself coated with a conductive layer 15. Holes 18, approximately 1.3 $\mu$m in diameter, have been produced through the layers 14 and 15 up to the conductive level 12 to deposit the tips 13 on said conductive level. The conductive layer 15 is used as an extraction gate for the electrons emitted by the tips 13. The anode 2 comprises a transparent substrate 21 coated with a transparent electrode 22 on which luminescent phosphors or luminophors 23 are deposited.

The operation of this screen is described below. The anode 2 is brought to a positive voltage of several hundred volts with reference to the tips 13 (typically 200 to 500 V). On the extraction gate 15, a positive voltage of several tens of volts (typically 60 to 100V) with reference to the tips 13 is applied. Electrons are then extracted at the tips 13 and are attracted by the anode 2. The electrons' paths are comprised in a top half-angle cone $\theta$ depending on different parameters, including the shape of the tips 13. This angle induces a defocusing of electron beam 31 which increases with the distance between the anode and the cathode. However, one of the ways to increase the efficiency of phosphors, and therefore the screen brightness, is to work with higher anode-cathode voltages (between 1000 and 10,000 V), which implies increasing the distance between the anode and the cathode further to prevent the formation of an electric arc between the two electrodes.

In order to retain a good resolution on the anode, the electron beam must be refocused. This refocusing is obtained conventionally using a gate that can be placed between the anode and the cathode or positioned on the cathode.

FIG. 2 illustrates the case in which the focusing gate is positioned on the cathode. FIG. 2 takes the same example as FIG. 1 but limited to a single microtip for more clarity in the drawing. An insulating layer 16 has been deposited on the extraction gate 15 and supports a metal layer 17 used as a focusing gate. Holes 19, of suitable diameter (typically between 8 and 10 mm) and concentric with the holes 18, have been engraved in the layers 16 and 17. The insulating layer 16 is used to insulate the extraction gate 15 and the focusing gate 17 electrically. The focusing gate is polarised with reference to the cathode so as to give the electron beam 32 the form represented in FIG. 2.

In the case of a microtip screen without a focusing gate, such as that shown in FIG. 1, the distance between two adjacent microtips is of the order of 3 $\mu$m. For a microtip screen with a focusing gate, as represented in FIG. 2, this distance is of the order of 10 to 12 $\mu$m. In this case, the microtip density, i.e. the electron emitter density, is between 9 and 16 times lower. This results in a decrease in screen brightness.

In a flat screen, the luminophors are deposited on the anode in the form of parallel bands, which are successively red-green-blue, etc. For a good restored image quality, the colours must not be mixed. For this, all the electrons emitted by a pixel of a given colour must go to the corresponding luminophor and not to the adjacent luminophors. This result is obtained by the focusing phenomenon. Given the band structure of the luminophors, it is important that the focusing is carried out in the direction perpendicular to these bands to prevent mixing of colours.

SUMMARY OF THE INVENTION

The invention makes it possible to remedy the problem of low microtip density posed by prior art focusing gate electron sources. This is obtained by replacing the circular apertures of the focusing gate by slits.

The invention proves to be particularly effective when applied to flat screens in which the luminophors are arranged in bands. It is proposed to etch, in the focusing gate, apertures in the form of slits, with the microtips aligned on the axes of these slits. By arranging the luminophors located on the anode in the form of bands parallel to the electron source slits and just above the corresponding slits, the electrons emitted by the microtips of these slits remain concentrated on the luminophor band facing them. Therefore, there will be no mixing of colours. If the focusing is not obtained in the direction of the bands, a slight spreading of the pixel in this direction is produced, which has a relatively insignificant effect on the image quality.

Therefore, the focusing gate according to the present invention performs a focusing function in a single direction.

Therefore, the invention relates to a microtip electron source comprising:

- at least one electron emission zone composed of a plurality of microtips connected electrically to a cathode conductor,
- at least one gate electrode, positioned opposite said electron emission zone and pierced with apertures located opposite the microtips, to extract the electrons from the microtips,
- an emitted electron focusing gate positioned opposite the gate electrode, and equipped with aperture means comprising at least one slit located opposite at least two successive microtips,
  - characterised in that the focusing gate is separated from the extraction gate electrode positioned opposite it by a layer of electrically insulating material with a slit aligned with the focusing gate slit, or a succession of holes aligned with the focusing gate slit, of a width less than that of the focusing gate slit.

According to an advantageous arrangement, the microtip electron source may comprise a plurality of electron emission zones arranged in the form of a matrix in rows and columns, with the number of cathode conductors and gate electrodes corresponding to the rows and columns to give the microtip electron source a matric access.

If each emission zone comprises several rows of microtips, each row of microtips has one or more corresponding slits in the focusing gate.

The invention also relates to a device comprising a first and second plane structure maintained opposite and at a determined distance from each other by means forming a spacer, the first plane structure comprising, on its inner device face, a microtip electron source such as that defined above, and the second plane structure comprising, on its inner device face, means forming the anode.

Such a device may be used to form a flat display screen, with luminophors placed between the microtip electron source and the means forming the anode.

The invention also relates to a flat display screen comprising a first and second plane structure maintained opposite and at a determined distance from each other by means forming a spacer, the first plane structure comprising, on its inner screen face, a microtip electron source such as that defined above, in which each emission zone comprises several rows of microtips and each row of microtips has one or more corresponding slits in the focusing gate, and the second plane structure comprising, on its inner screen face, means forming the anode, a conductive layer forming the anode and supporting luminophors arranged in alternating red, green and blue bands, with each band located parallel to and opposite a series (row or column) of electron emission zones, with the main axis of the focusing gate slits directed in the direction of the luminophor bands and each emission zone defining a pixel for the display screen.

Naturally, the microtip electron source according to the present invention may be used in relation with anodes of different structures, particularly conventional structures produced for cathode ray tube screens, adapted for flat screens.

The invention also relates to a microtip and focusing gate electron source manufacturing process, comprising:

a step in which the following are successively deposited on one face of an electrically insulating substrate: cathode connection means, a first electrically insulating layer of a thickness adapted to the height of the future microtips, a first conductive layer intended to form the extraction gate, a second electrically insulating layer of a thickness corresponding to the distance to separate the extraction gate from the focusing gate, a step consisting of piercing the second insulating layer with holes up to the first conductive layer, with the axes of the holes corresponding to the axes of the future microtips and the diameter of these holes adapted to the size of the future microtips, an electrolytic deposition step of conductive material in said holes, with the first conductive layer acting as the electrode during the electrolysis, the electrolytic deposit filling said holes from the first conductive layer and flowing onto the second insulating layer, first of all giving the electrolytically deposited conductive material the shape of mushrooms, the caps of which rest on the second insulating layer, with the electrolytic deposit subsequently producing, due to coalescence of the mushroom caps formed in adjacent and sufficiently close holes, an approximately semi-cylindrical shaped mass for each set of adjacent and sufficiently close holes, a deposition step of a second conductive layer intended to form the focusing gate, with the material of this second conductive layer being different to that of the electrolytically deposited conductive material, an electrolytically deposited material removal step, with this removal leaving, in the second conductive layer, one slit for each previously formed mass, the main axis of which is aligned with the holes with which it was formed, a hole deepening step up to the cathode connection means, an etching step of the second insulating layer to reveal the first conductive layer, a microtip formation step on the cathode connection means revealed by the hole deepening step.

The hole deepening step may be performed by etching. This step and the second insulating layer etching step may be performed simultaneously.

The invention also relates to a microtip and focusing gate electron source manufacturing process, comprising:

a step in which the following are successively deposited on one face of an electrically insulating substrate: cathode connection means, a first electrically insulating layer of a thickness adapted to the height of the future microtips, a first conductive layer intended to form the extraction gate, a second electrically insulating layer of a thickness corresponding to the distance to separate the extraction gate from the focusing gate, a masking layer, a step consisting of piercing holes through the complex formed by the masking layer, the second insulating layer and the first conductive layer up to the first insulating layer, with the axes of the holes corresponding to the axes of the future microtips and the diameter of these holes adapted to the size of the future microtips, a hole deepening step in the first insulating layer up to the cathode connection means, a lateral etching step of the second insulating layer to increase the diameter of the holes pierced previously to a determined value, with this lateral etching being able to render adjacent and sufficiently close holes secant, a masking layer removal step, an electrolytic deposition step of conductive material in said holes, with the first conductive layer acting as the electrode during the electrolysis, the electrolytic deposit filling said holes from the first conductive layer and flowing onto the second insulating layer, first of all giving the electrolytically deposited conductive material the shape of mushrooms, the caps of which rest on the second insulating layer, with the electrolytic deposit subsequently producing, due to coalescence of the mushroom caps formed in adjacent and sufficiently close holes, an approximately semi-cylindrical shaped mass for each set of adjacent and sufficiently close holes, a deposition step of a second conductive layer intended to form the focusing gate, with the material of this second conductive layer being different to that of the electrolytically deposited conductive material, an electrolytically deposited material removal step, with this removal leaving, in the second conductive layer, one slit for each previously formed mass, the main axis of which is aligned with the holes with which it was formed, a microtip formation step on the cathode connection means through the holes produced in the first conductive layer and the first insulating layer.

The hole deepening step in the first insulating layer and the lateral etching step of the second insulating layer may be performed simultaneously by isotropic etching.

Irrespective of the process implemented, the step consisting of piercing holes may be carried out by etching. The electrolytically deposited material removal step may be carried out by chemical dissolution. The cathode connection means may be obtained by deposition of cathode conductors on the substrate, followed by deposition of a resistive layer.

BRIEF DESCRIPTION OF THE DRAWINGS

A better understanding of the invention and the demonstration of other advantages and specific features can be obtained in the following description, given as non-restrictive examples, accompanied by the appended drawings, of which.

DESCRIPTION OF THE PREFERRED EMBODIMENTS

Figure 3:
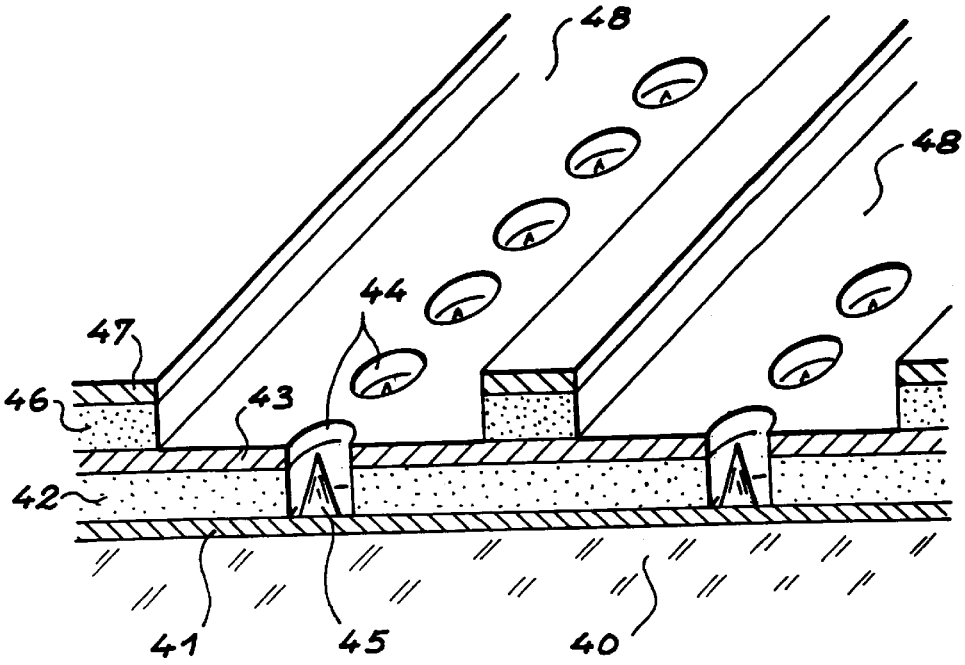
FIG. 3 is a partial and perspective view of a first variant of a microtip electron source according to the present invention.

FIG. 3 is a partial and section view of a microtip electron source according to the invention. It has been produced using a glass substrate 40. On this substrate 40, the following have been successively deposited: a first layer 41 forming cathode connection means, a first insulating layer 42 and a first conductive layer 43. In the layers 42 and 43, holes 44 have been etched up to the first layer 41. Electron emitters 45, in the form of tips, have been deposited inside the holes 44 in contact with the first layer 41. The microtips 45 are arranged in alignments. To use the electron source as a flat colour display screen cathode, the microtip alignments are parallel to the luminophor bands arranged on the screen anode.

Figure 1:
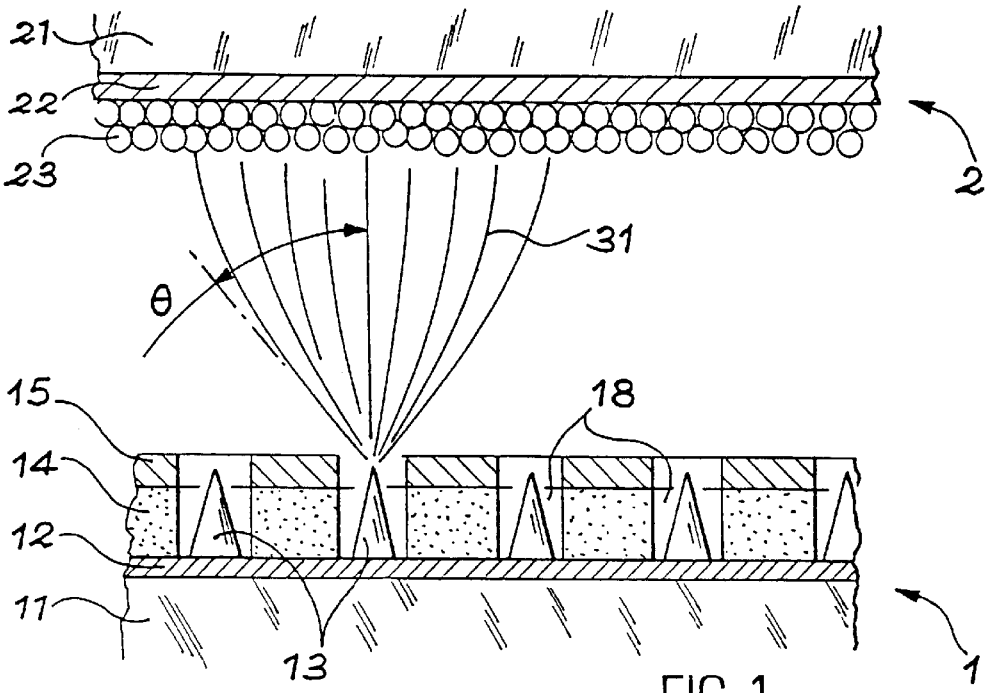
FIG. 1 PRIOR ART
FIG. 1 illustrates a microtip flat screen according to the prior art.
Figure 2:
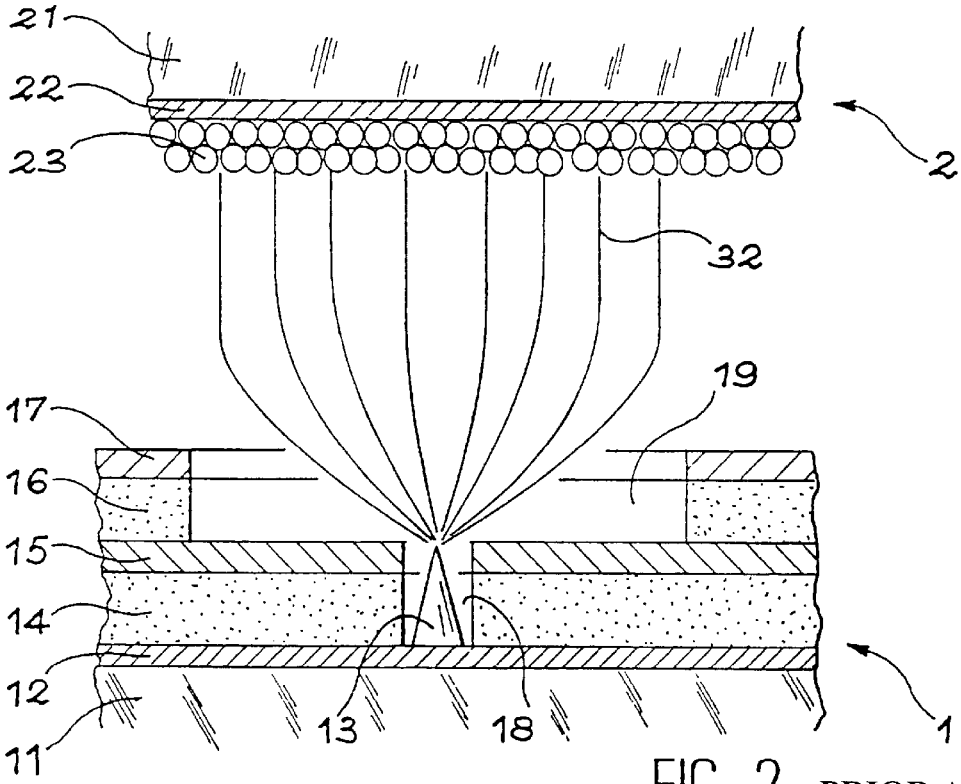
FIG. 2 PRIOR ART
FIG. 2 illustrate a microtip and focusing gate flat screen according to the prior art.

The conductive layer 43 is used as an electron extraction gate. It is coated with an insulating layer 46 (second insulation layer) and a conductive layer 47 (second conductive layer). Slits 48 have been produced in the layers 46 and 47 to reach the extraction gate 43. The axes of the slits 43 are combined with the axes of the alignments of emitters or microtips 45. The slits 48 may have a width of 8 to 10 $\mu$m. The spacing of the slits (along their main axis) and, as a result, the spacing of the rows of emitters, is 10 to 12 $\mu$m. The distance between two emitters on the same row is of the order of 3 $\mu$m. Therefore, the solution proposed by the invention enables an emitter density that is 3 to 4 times than in the case where focusing is carried out in all directions from each of the emitters (case of FIG. 2).

The microtip electron source represented in FIG. 3 is generally intended for use as a flat display screen cathode. This flat screen is a device composed of a cathodic structure and an anodic structure facing each other, between which a vacuum is produced. The distance separating the extraction gate 43 from the focusing gate 47 is very short. In some cases of use, this may result in the risk of an electric arc in the vacuum between these two gates.

Figure 4:
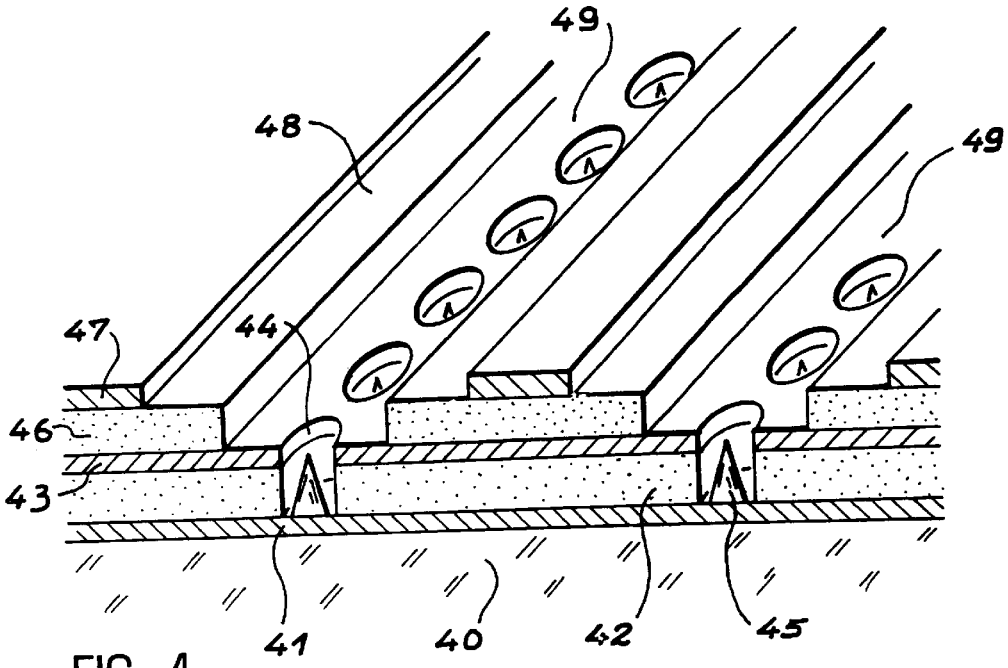
FIG. 4 is a partial and perspective view of a second variant of a microtip electron source according to the present invention.

A solution to remedy this disadvantage is represented in FIG. 4 where the same components as for FIG. 3 are designated by the same references. In the case of FIG. 4, the slits 48 have been limited to the focusing gate. The insulating layer 46 has been etched with slits 49 centred on the corresponding emitter rows and of a width less than the width of the slits 48. As a variant, the insulating layer 46 may be pierced with holes concentric with the holes 44. The diameter of these concentric holes or the width of the slits 49, depending on the case, may be two to three times the diameter of the holes 44. In this way, the extension of the insulating layer 46 onto the extraction gate 43 provides improved protection against electric arcs.

The electrons emitted by the microtips corresponding to a focusing gate slit of an electron source according to the present invention are focused in the direction perpendicular to the slit axis. They only deviate very insignificantly from the plane perpendicular to the source passing through the slit axis. Therefore, the impacts of these electrons on a plane parallel to the cathode are located in a narrow band parallel to, but slightly longer than, the slit axis.

Electron sources such as those represented in FIGS. 3 and 4 may be produced using conventional microelectronic deposition, photolithography and etching techniques, with the microtips produced according to the prior art. However, simulation calculations demonstrate that the focusing quality depends on the centring of the focusing gate along the emitter axis and that this parameter is very sensitive. The required precision requires the use of high-performance devices, the suitability of which decreases as the screen size increases.

To remedy this problem, it is proposed to produce the focusing gate using a self-alignment process.

A first example of this process is illustrated by FIGS. 5A to 5D. It makes it possible to obtain a microtip electron source of the type represented in FIG. 3.

Figure 5A:
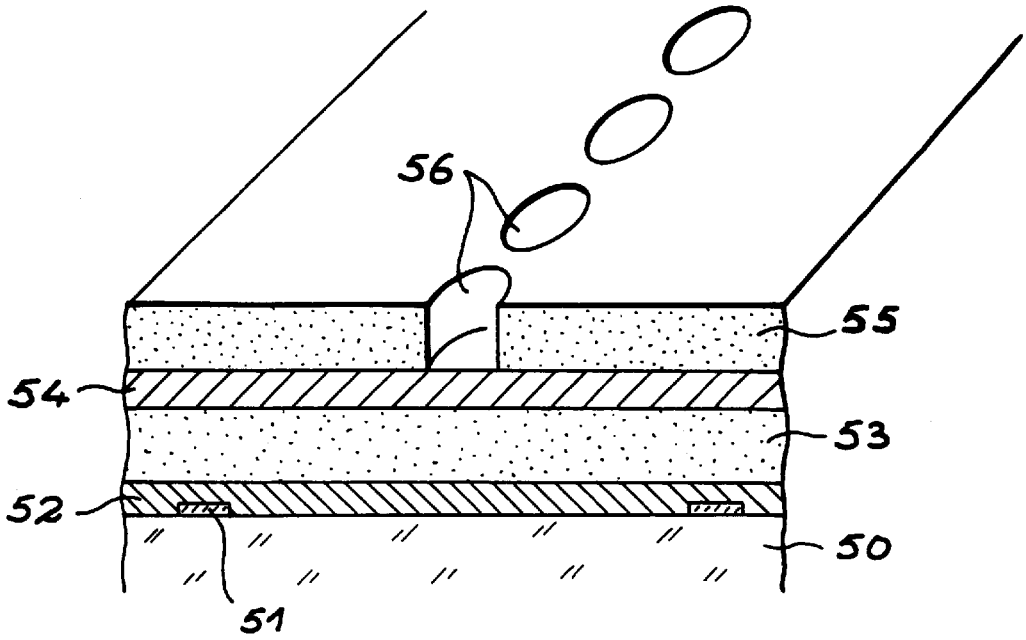
FIGS. 5A to 5D illustrate a manufacturing process of a microtip electron source of the type represented in FIG. 3, FIGS. 6A to 6E illustrate a manufacturing process of a microtip electron source of the type represented in FIG. 4.

With reference to FIG. 5A, a metal layer, which has been etched to form columns 51, has been deposited on a glass plate 50. A resistive layer 52 has then been deposited uniformly in order to produce a plane surface. On the resistive layer 52, the following have then been successively deposited: a first insulating layer 53, a conductive layer 54 and a second insulating layer 55. The thickness of these different layers is adapted to the required structure. The insulating layers 53 and 55 may be silica. The conductive layer 54, intended to form the electron extraction gate, may be niobium.

Then, using conventional photolithography and etching techniques, holes 56, the centres of which are aligned on parallel lines, are etched in the insulating layer 55. The holes 56 reveal the conductive layer 54. The distance between two successive holes on the same row is of the order of 3 $\mu$m. The distance between two consecutive rows is approximately 10 to 12 $\mu$m. For increased clarity, FIG. 5A only represents a small part of a single row of holes.

The next step (see FIG. 5B) consists of performing electrolytic deposition of a conductive material (e.g. an iron-nickel alloy) on the revealed parts of the conductive layer 54, i.e. at the base of the holes 56. The thickness of the electrolytic deposit is adjusted so as to obtain, for each hole, the formation of a mushroom, the base of which fills the hole and such that the cap is developed on the outer face of the insulating layer 55. The formation is continued until the cap diameter reaches the required width for the focusing gate slit. Since this width is approximately 10 $\mu$m, the mushrooms will coalesce to form a semi-cylindrical shaped mass 57 of a diameter equal to the required slit width.

Figure 5B:
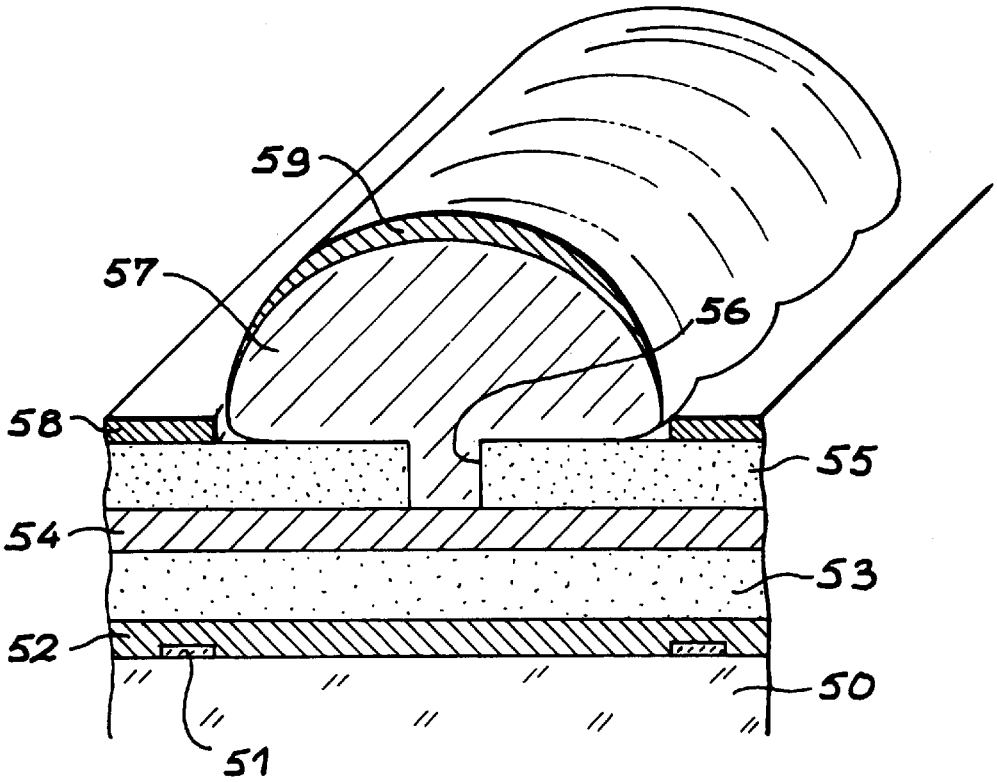

Using a vacuum deposition technique adapted to the type of material to be deposited, a second conductive layer is then deposited to form the focusing gate. This second conductive layer (metal or another resistive material) is deposited on the insulating layer 55 between the masses 57, to form the deposit 58, and on the masses 57 to form the deposit 59, as represented in FIG. 5B. Each mass 57 serves as a mask for the focusing gate aperture. Since the axis of each semi-cylinder forming a mass passes through the line joining the centres of the holes, the aperture obtained will be automatically centred on this line.

Figure 5C:
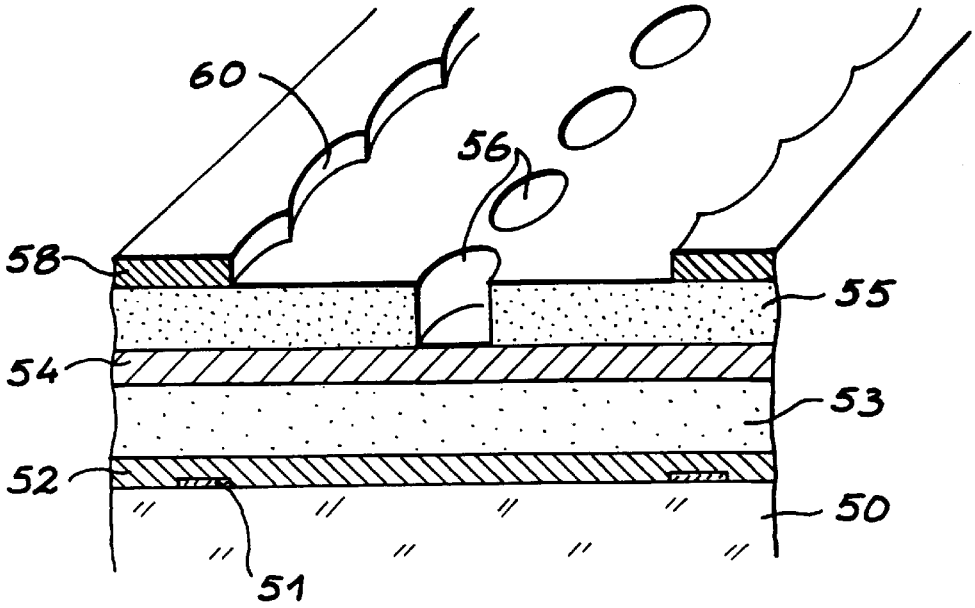

The masses 57 are then dissolved chemically and the structure represented in FIG. 5C is obtained. The apertures 60 produced in the focusing gate 58 are centred on the axes of the holes 56.

Figure 5D:
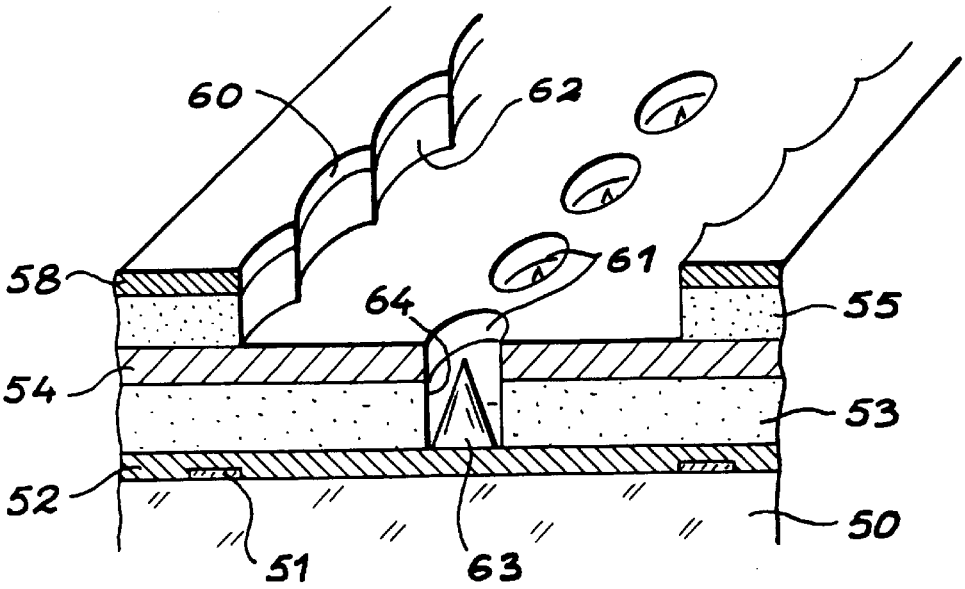

The metal layer 54 is then etched anisotropically through the holes 56 to deepen this hole up to the first insulating layer 53. The anisotropic etching is continued in the insulating layer 53 until the resistive layer 52 is reached. Since the insulating layers 53 and 55 are both made of silica in the example described, the etching of these two layers may be performed simultaneously. This produces, as shown in FIG. 5D, holes 61 and 64 (following the holes 56 in FIG. 5C) passing through the conductive layer 54 and the insulating layer 53, respectively. An aperture 62 in the form of a slit is also obtained following from the slit 60.

The microtips 63 are then produced conventionally, at the base of the holes 61. Therefore, the microtips, the extraction gate holes and the focusing gate slits are self-aligned.

A second example of the self-alignment process is illustrated in FIGS. 6A to 6E. It is used to obtain a microtip electron source of the type represented in FIG. 4.

Figure 6A:
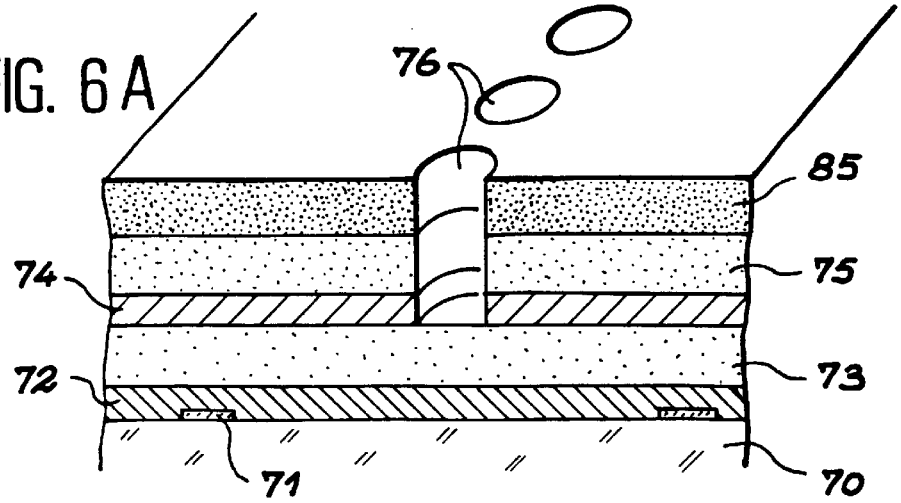
Figure 6B:
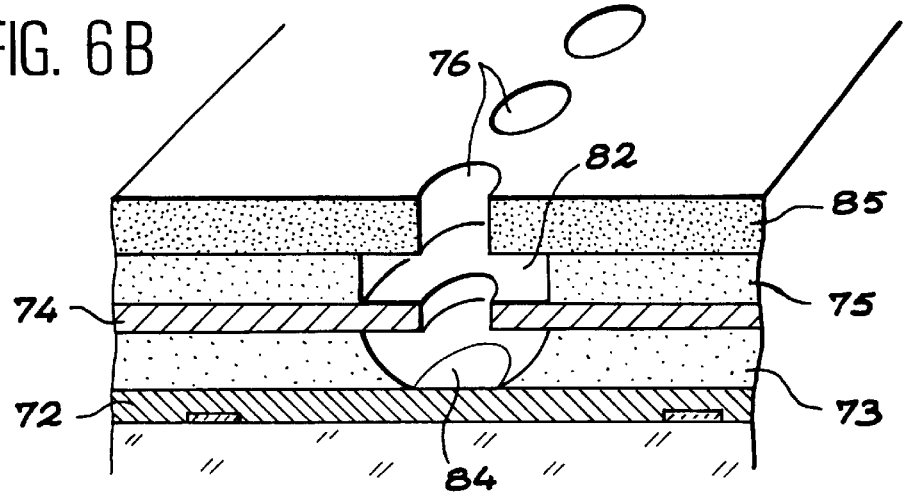

With reference to FIG. 6A, cathode conductor columns 71 and a resistive layer has been deposited on a glass plate 70, as for the first process example. On the resistive layer 72, the following have then been, successively deposited: a first insulating layer 73, a conductive layer 74 and a second insulating layer 75 of the same type as the first insulating layer 73. Finally, a layer of resin 85 has been deposited. The choice of layer thickness and materials used may be the same as for the first process example.

Holes 76 have been opened in the resin layer 85 which serves as a mask for the etching of the insulating layer 75 and the conductive layer 74. Therefore, the holes 76 are deepened to reach the first insulating layer 73.

The chemical etching of the first insulating layer 73 is then performed so as to extend the holes to the resistive layer 72. By performing isotropic etching, significant excess etching is obtained and the holes 84 produced in the first insulating layer will have the profile shown in FIG. 6B. Since it is of the same type as the first insulating layer 73, the second insulating layer 75 is etched in the same way. An increase in the diameter of the holes 76, between the conductive layer 74 and the resin layer 85 is obtained, providing cavities 82. This increase in diameter is equal to at least twice the thickness of the first insulating layer 73.

Figure 6C:
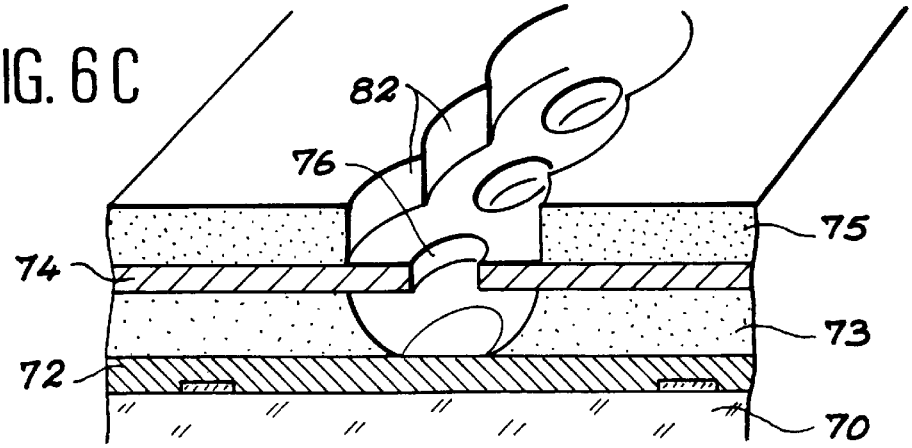

FIG. 6C represents the structure obtained after the removal of the resin layer. The second insulating layer 75 comprises holes 82 coaxial with, but of a larger diameter than, the holes 76 of the conductive layer 74. These holes 82 may be isolated or secant (as shown in FIG. 6C) according to the thickness of the first insulating layer 73 and the distance between the holes 76 of a same row of holes.

Figure 6D:
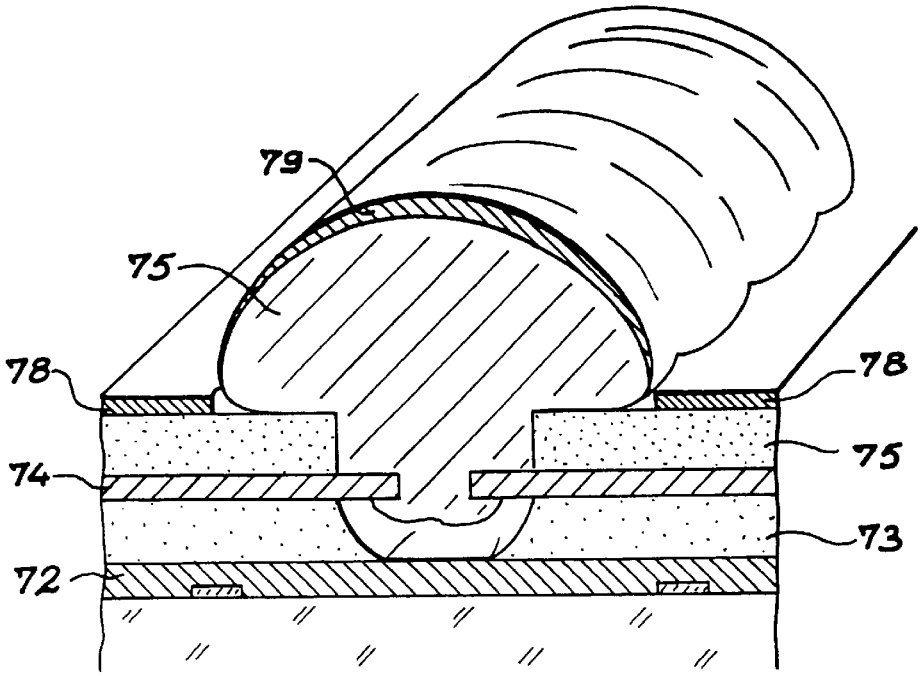

Electrolytic deposition of a conductive material is then carried out from the conductive layer 74. The deposition step is conducted so as to obtain semi-cylindrical shaped masses 77 of a diameter equal to the required width for the focusing gate slit (e.g. 10 $\mu$m). This is shown in FIG. 6D.

As for the first process example, a second conductive layer is deposited to form the focusing gate. The deposit 78 between the masses 77 and the deposit 79 on the masses 77 are obtained.

Figure 6E:
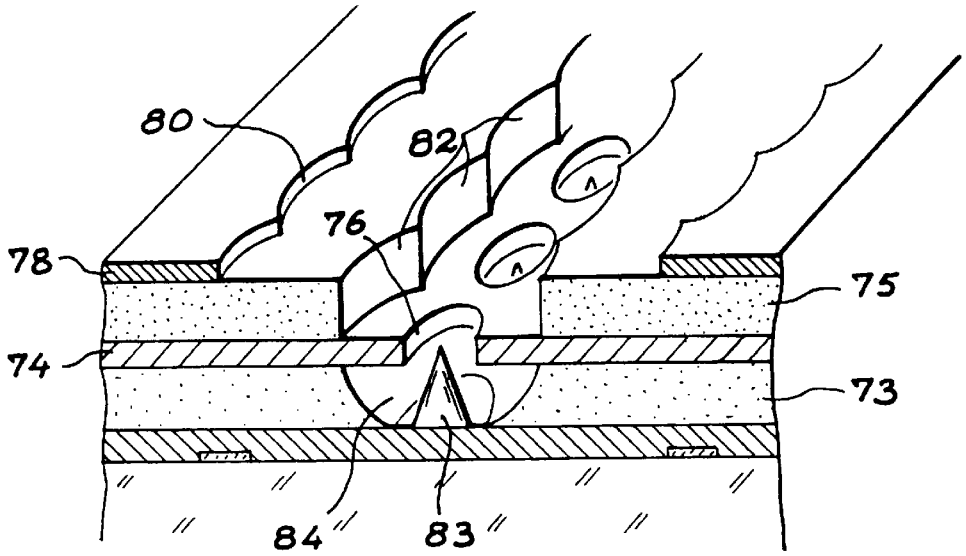

The masses 77 are then dissolved chemically to give the structure the profile represented in FIG. 6E. The apertures 80 produced in the focusing gate 78 are centred on the axes of holes 76. This gate 78 is placed on the insulating layer 75, itself comprising an aperture (formed by the succession of adjacent holes 82) centred on the row of holes 76, the aperture in the second insulating layer 75 being narrower than that of the focusing gate 78.

The microtips 83 are then produced conventionally at the base of the holes 84. Therefore, the microtips, extraction gate holes and the focusing gate slits are self-aligned.

Figure 7:
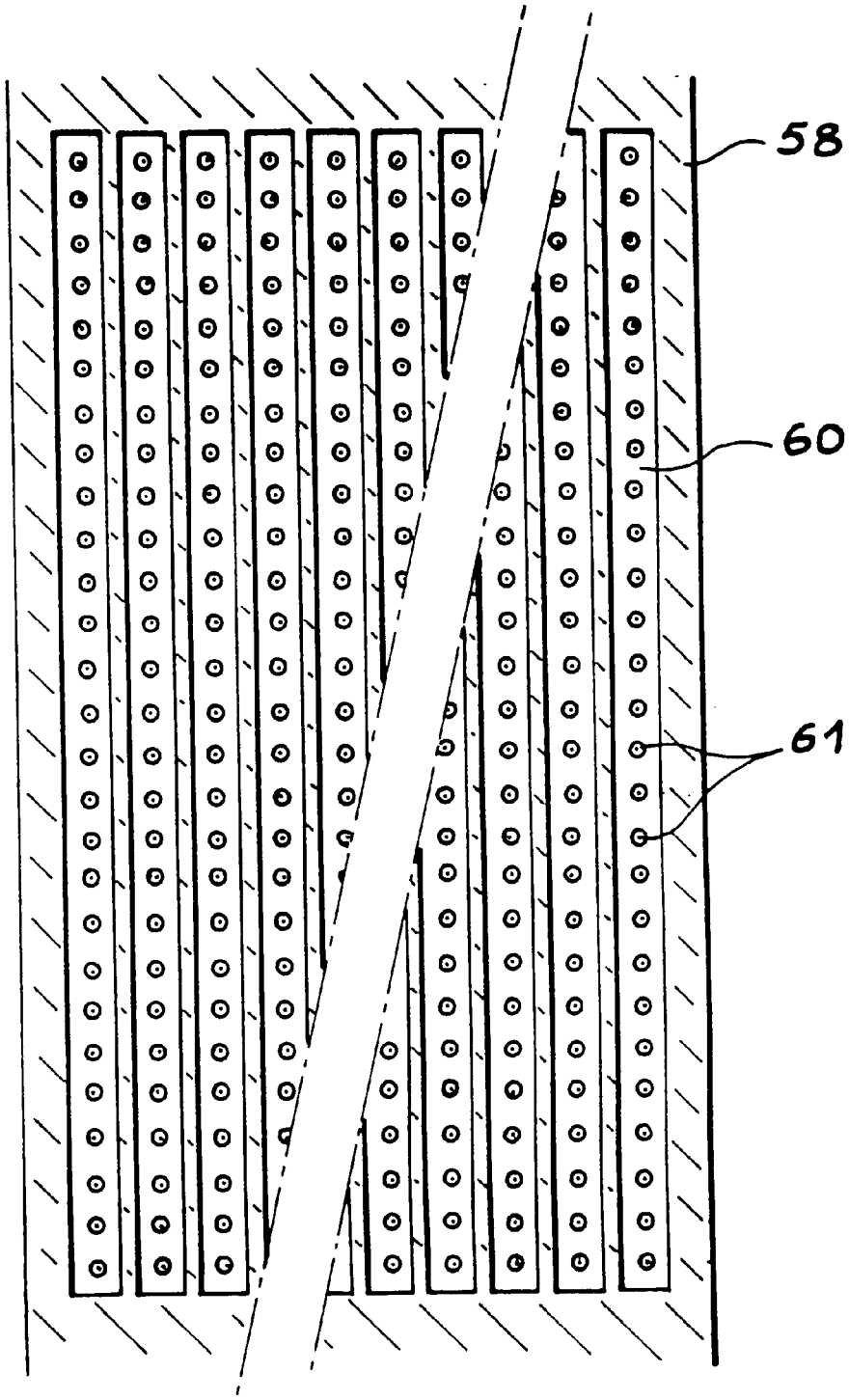
FIG. 7 is a top view of a first flat display screen microtip electron source according to the present invention, with this view only showing part of the electron source corresponding to a pixel of the screen.
Figure 8:
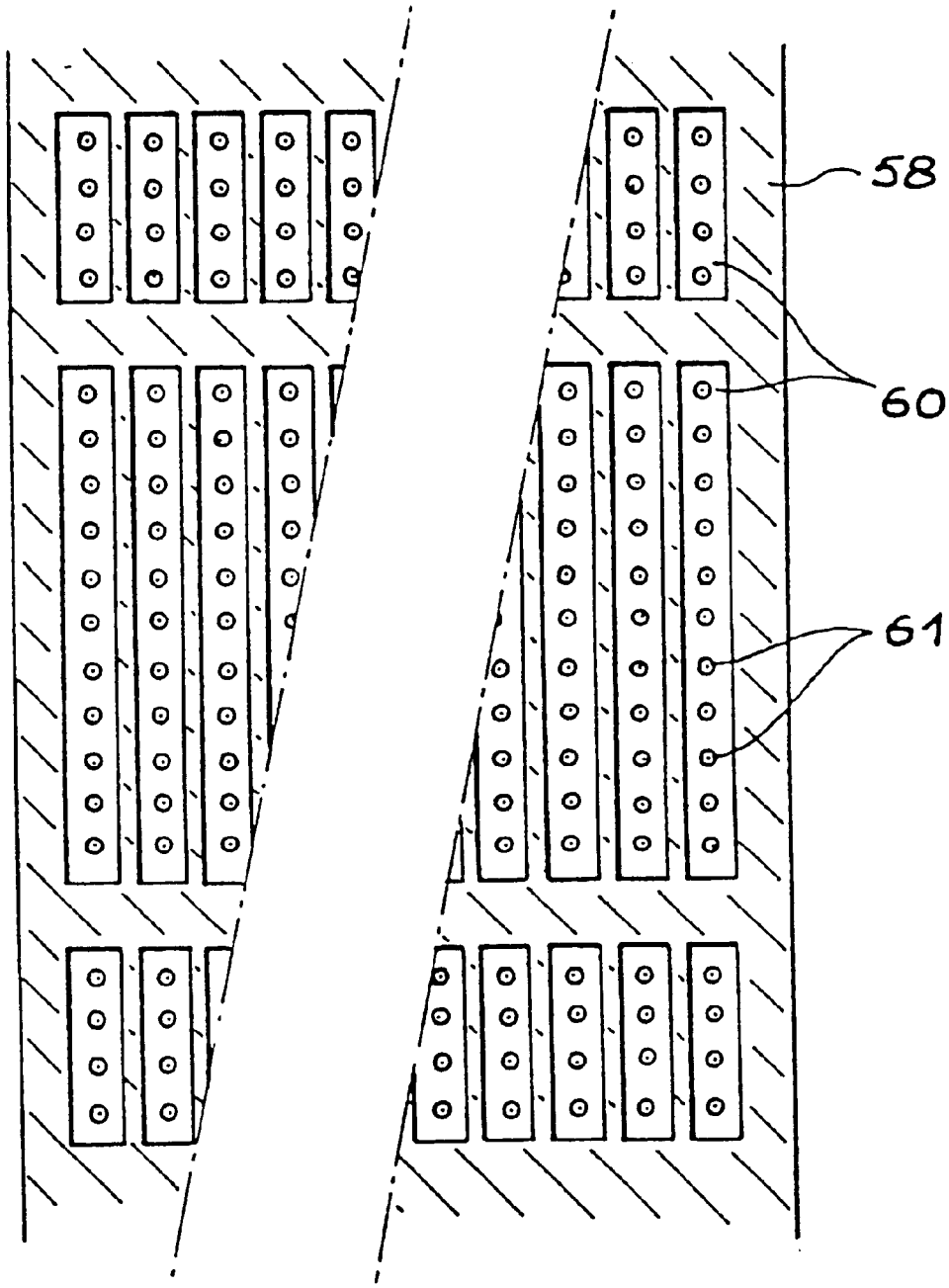
FIG. 8 is a top view of a second flat display screen microtip electron source according to the present invention, with this view only showing part of the electron source corresponding to a pixel of the screen.

Viewed from above, the microtip electron source, e.g. obtained using the first self-alignment process example, may appear as shown in FIGS. 7 and 8. These figures only show part of the electron source corresponding to one pixel on the screen. The extraction gate holes 61, at the base of which the electron emitters are placed, are aligned in the slits 60 of the focusing gate 58. These slits may be the same length as the pixel, as in FIG. 7. This may be split into several parts, as in FIG. 8.

What is claimed is:

1. Microtip electron source comprising:

at least one electron emission zone composed of a plurality of microtips connected electrically to a cathode conductor, at least one gate electrode, positioned opposite said electron emission zone and pierced with apertures located opposite the microtips, to extract the electrons from the microtips, an emitted electron focusing gate, positioned opposite the gate electrode, and comprising aperture means located opposite the microtips, the aperture means of the focusing gate comprising at least one slit located opposite at least two successive microtips, wherein the focusing gate is separated from the extraction gate electrode positioned opposite it by a layer of electrically insulating material comprising a slit aligned with the slit of the focusing gate, or a succession of holes aligned with the focusing gate slit, of a width less than that of the focusing gate slit.

2. Microtip electron source according to claim 1, comprising a plurality of electron emission zones arranged in the form of a matrix in rows and columns, with the number of cathode conductors and gate electrodes corresponding to the rows and columns to give the microtip electron source a matrix access.

3. Microtip electron source according to claim 2, wherein, each emission zone comprising several rows of microtips, and each row of microtips has one or more corresponding slits in the focusing gate.

4. Flat display screen comprising:

a first and second plane structure maintained opposite and at a determined distance from each other by means forming a spacer, wherein the first plane structure comprises, on its inner screen face, a microtip electron source according to claim 3, and the second plane structure comprises, on its inner screen face, a conductive layer forming an anode and supporting luminophors arranged in alternating red, green, and blue bands, with each band located parallel to and opposite a series of electron emission zones, with the main axis of the focusing gate slits directed in the direction of the luminophor bands and each emission zone defining a pixel for the display screen.

5. Device comprising:

a first and second plane structure maintained opposite and at a determined distance from each other by means forming a spacer, wherein the first plane structure comprises, on its inner device face, a microtip electron source according to claim 1, and the second plane structure comprises, on its inner device face, means forming an anode.

6. Flat display screen composed of a device according to claim 5, with luminophors placed between the microtip electron source and the means forming the anode.

7. Microtip and focusing gate electron source manufacturing process, comprising:

a step wherein the following are successively deposited on one face of an electrically insulating substrate: cathode connection means, a first electrically insulating layer of a thickness adapted to the height of the future microtips, a first conductive layer intended to form the extraction gate, a second electrically insulating layer of a thickness corresponding to the distance to separate the extraction gate from the focusing gate, a masking layer, a step consisting of piercing holes through the complex formed by the masking layer, the second insulating layer up to the first conductive layer, with the axes of the holes corresponding to the axes of the future microtips and the diameter of these holes adapted to the size of the future microtips, a hole deepening step in the first insulating layer up to the cathode connection means, a lateral etching step of the second insulating layer to increase the diameter of the holes pierced previously to a determined value, with this lateral etching being able to render adjacent and sufficiently close holes secant, a masking layer removal step, electrolytic deposition step of conductive material in said holes, with the first conductive layer acting as the electrode during the electrolysis, the electrolytic deposit filling said holes from the first conductive layer and flowing onto the second insulating layer, first of all giving the electrolytically deposited conductive material the shape of mushrooms, the caps of which rest on the second insulating layer, with the electrolytic deposit subsequently producing, due to coalescence of the mushroom caps formed in adjacent and sufficiently close holes, an approximately semi-cylindrical shaped mass for each set of adjacent and sufficiently close holes, a deposition step of a second conductive layer intended to form the focusing gate, with the material of this second conductive layer being different to that of the electrolytically deposited conductive material, an electrolytically deposited material removal step, with this removal leaving, in the second conductive layer, one slit for each previously formed mass, the main axis of which is aligned with the holes with which it was formed, a microtip formation step on the cathode connection means through the holes produced in the first conductive layer and the first insulating layer.

8. Process according to claim 3, wherein the hole deepening step in the first insulating layer and the lateral etching step of the second insulating layer are performed simultaneously by isotropic etching.

9. Process according to claim 7, wherein the step consisting of piercing holes is performed by etching.

10. Process according to claim 7, wherein the electrolytically deposited conductive material removal step is performed by chemical dissolution.

11. Process according to claim 7, wherein the cathode connection means are obtained by deposition of cathode conductors on the substrate, followed by deposition of a resistive layer.

* * * * *

UNITED STATES PATENT AND TRADEMARK OFFICE

CERTIFICATE OF CORRECTION

PATENT NO. : 6,534,913 B1
DATED : March 18, 2003
INVENTOR(S) : Perrin et al.

It is certified that error appears in the above-identified patent and that said Letters Patent is hereby corrected as shown below:

Title page,
Item [86], should read:

-- (86) PCT No.: PCT/FR98/02197

§ 371 (c)(1),
(2), (4) Date: May 8, 2000 --

Signed and Sealed this

Twenty-ninth Day of July, 2003

JAMES E. ROGAN
*Director of the United States Patent and Trademark Office*